United States Patent [19]

Roszel et al.

[11] Patent Number: 4,680,536

[45] Date of Patent: Jul. 14, 1987

[54] DIMMER CIRCUIT WITH INPUT VOLTAGE COMPENSATED SOFT START CIRCUIT

[75] Inventors: Lynn Roszel, Richardson; Jim Tabor, Dallas, both of Tex.

[73] Assignee: Prescolite, Inc., San Leandro, Calif.

[21] Appl. No.: 784,543

[22] Filed: Oct. 4, 1985

Related U.S. Application Data

[63] Continuation of Ser. No. 467,233, Feb. 17, 1983, abandoned.

[51] Int. Cl.[4] ..... G05F 5/02

[52] U.S. Cl. ..... 323/321; 315/194; 323/300; 323/324; 323/326

[58] Field of Search ..... 323/238, 239, 237, 242, 323/300, 321, 324, 326, 901, 905; 315/194, 199, 251, 275

[56] References Cited

U.S. PATENT DOCUMENTS

| | | | |
|---|---|---|---|
| 3,244,965 | 4/1966 | Gutzwiller | 323/324 |
| 3,331,013 | 7/1967 | Cunningham | 323/239 |
| 3,872,374 | 3/1975 | Rasmussen | 323/300 |

FOREIGN PATENT DOCUMENTS

| | | | |
|---|---|---|---|
| 2415632 | 10/1975 | Fed. Rep. of Germany | 323/321 |
| 2646126 | 4/1978 | Fed. Rep. of Germany | 323/324 |
| 19379 | 2/1981 | Japan | 323/321 |

OTHER PUBLICATIONS

"Speed Control Compensates for Abnormal Line Voltage," reprint from Aug. 1970 issue of EDN.

*Primary Examiner*—William H. Beha, Jr.
*Attorney, Agent, or Firm*—Bielen & Peterson

[57] ABSTRACT

A circuit for controlling the initiation and operation of a phase control circuit employed in voltage regulation to a load such as dimming lights. The circuit uses a power semi-conductor which is triggered by a "walk-in" circuit. The "walk-in" circuit includes a regulator diode across a diode bridge which stabilizes the output of the load, such as a level of lighting.

2 Claims, 2 Drawing Figures

DIMMER CIRCUIT WITH INPUT VOLTAGE COMPENSATED SOFT START CIRCUIT

BACKGROUND OF THE INVENTION

This is a continuation of application Ser. No. 467,233 filed Feb. 17, 1983, now abandoned.

The present invention relates to a novel circuit for controlling the delivery of electrical voltage from a source to load which is especially useful in dimming lamps.

Dimmers have been used widely to control the output of the lamps. Dimmers enjoy the advantage of saving energy and extending the life of the lamp being used.

Solid state switching devices such as silicon controlled rectifiers (SCR) or triacs have been widely used in this regard. For example U.S. Pat. No. 3,414,766 describes a dimmer circuit employing such a device.

Problems arise when high inrush currents which are demanded by a cold incandesent lamp when the dimmer is first energized. These currents can be very destructive to the components of the dimmers such as the SCR's and to the tungsten filament in the lamp. Reference is made to U.S. Pat. No. 4,360,743 which provides for a device to gradually turn on and off an electrical load. Other circuits of this type are shown in U.S. Pat. 4,008,416, 4,037,135, 4,152,607, and 4,160,192. Other circuits, such as the one shown in U.S. Pat. No. 3,811,054, use solid state switching devices to simplify lighting installations.

U.S. Pat. Nos. 3,588,598 and 3,890,562 describe use of SCR's which increase the control and regulation of circuitry.

Another problem arises in that line voltage may vary during the operation of the dimmer. This results in unsteady or changing light levels. U.S. Pat. No. 3,821,601 describes a system for regulating a dimmer for incandescent lamps which employs a feedback circuit.

There is a need for a control circuit which may be utilized as a dimmer which employs a soft start and may be compensated for line voltage vibrations.

SUMMARY OF THE INVENTION

In accordance with the present invention a novel circuit for controlling the delivery of electrical voltage from a source to a load which is especially useful for dimming an incandescent lamp is provided. The circuit of the present invention has a soft-start feature and may compensate for line voltage variations.

The circuit of the present invention utilizes switch means for selectively conducting current from the source to the load which may be a lamp. Switch means may take the form of a TRIAC which has a multiplicity of conduction of angles. The triac would also possess gate lead means for initiating the selective conduction of current from the source to the load.

The invention also includes means for triggering the gate lead of the switch means. Such triggering means might take the form of a diac connected in series with the gate lead of a triac.

Means for activating the triggering means during a selected time intervals is also provided. Such activating means may embrace a capacitor having first and second terminals. A first terminal of the capacitor would be connected to a variable resistor and the second terminal of the capacitor would be connected to means for producing a regulated pulsating D.C. voltage. Such means may take the form of a full wave rectifier bridge with a regulator diode connected across the bridge. The bridge would be placed between the source of electrical voltage and the load.

In addition, the circuit of the present invention may have means for delaying the operation of the activating means which would cause the switch means or triac to progressively increase success of periods of conduction of current, increasing conduction angles. Such delaying means may take the form of a capacitor placed across the regulator diode.

Another feature of the present invention utilizes compensation means for regulating the current output of the switch means in relation to variations in the voltage from the power source. Compensation means is achieved by placing a diac across the full wave rectifier bridge. Thus the characteristic of a diac which decreases its voltage with an increase of current serves to compensate for line voltage changes to the activating means. The circuit of the present may also include an on-off switch placed between the source and the load.

It may be apparent that a novel and useful circuit for controlling the voltage to a load which is especially useful for dimming a lamp has been described.

It is an object of the present invention to provide a circuit for dimming a lamp which would eliminate high inrush currents during the initiation, which could damage components of the dimmer circuitry or the lamp itself.

It is another object of the present invention to provide a circuit for controlling the voltage to a load which may employ a variable resistor and an ON-OFF switch in combination without damage to components of the circuit or to the load during operation.

It is yet another object of the present invention to provide a circuit for controlling the voltage to a load which may be used as a dimmer for an incandescent lamp which utilizes "soft start" feature.

It is still another object of the present invention to provide a circuit for controlling the delivery of voltage from a source to a load which compensates for variations and the line voltage of the source.

The invention possesses other objects and advantages especially as concerns particular characteristics and features thereof which will become apparent as the specification continues.

For a better understanding of the invention references made to the following detailed description which should be referenced to the hereinabove described drawings.

DESCRIPTION OF THE PREFERRED EMBODIMENTS

Various aspects of the present invention will evolve from the following detailed description of the preferred embodiments thereof which should be taken into conjunction with the hereinabove described drawings.

Figure 1:
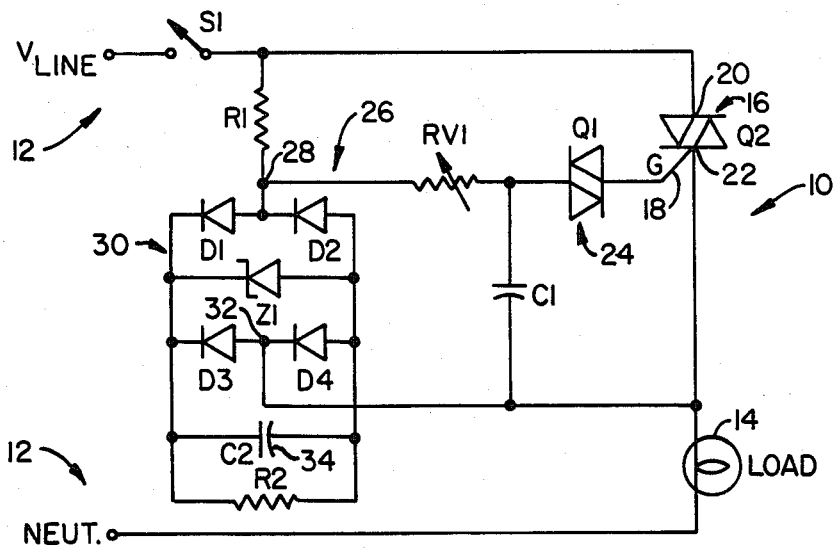
FIG. 1 is a detailed circuit schematic of a first embodiment of the control circuit capable of dimming an incandescent lamp utilizing a "soft start" feature.

The invention as a whole is represented in the drawings as reference character 10 and 10*a*. Circuit 10 is found on FIG. 1 while circuit 10*a* is found on FIG. 2. Circuit 10 includes as one of its elements a source of electrical power or voltage 12 which is used to power load 14. Load 14 can be an incandescent lamp in which case circuit 10 would be used for dimming of the incandescent lamp.

Another element of the circuit is found in switch means 16 for selectively conducting current from source 12 to load 14. Switch means may take the form of a triac Q-2 which includes a gate 18 and terminals 20 and 22. When a current is injected at gate 18 terminals 20 and 22 will conduct current to load 14. Thus gate lead means 18 initiates the selective conduction of current to load 14.

Means 24 is also provided for triggering gate lead means 18. Such triggering means may take perform of a diac Q-1 which breaks down when a sufficient voltage is supplied thereto.

Means 26 is also found in circuit 10 for activating triggering means 24 during selected time intervals. It may be apparent that this activation will, in turn, cause triac 16 to conduct or fire during each half-cycle of the line voltage from source 12. Activating means 26 may include a resistor R-1 of relatively high value. After passing through R-1 the voltage from source 12 arrives at node 28. From there it is sent through full wave rectifier bridge 30 having diodes D-1, D-2, D-3 and D-4. A regulator diode or zener diode Z-1 is placed across bridge 30. Thus a pulsating D.C. voltage is found at node 32.

Variable resistor (potentiometer) RV-1 also connects to the downside of resistor R-1. RV-1 represents the actual dimming control adjusted by the user. A capacitor C-1 connects one terminal to RV-1 while the other terminal is connected to the output of bridge 30. Thus capacitor C-1 can charge through variable resistor RV-1 during the time voltage is impressed across bridge 30. This charging is relatively uniform in that zener diode Z-1 aids in the production of a square wave form to one terminal of capacitor C-1. The charging of capacitor C-1 breaks down diac Q-1 and causes triac Q-2 to fire.

Assuming triac Q-2 is non-conductive, currents will flow through R-1, D-1, Z-1, D-4, to the load on the positive half-cycle. Currents through load 14 will be very low during this phase. While this is occurring, capacitor C-1 charges through variable resistor RV-1 and will break down diac Q-1 if RV-1 is set at a sufficiently low value. Thus, triac $Q_2$ *'is caused to conduct current to load* 14 *when this occurs. A switch S-*1 *is also found in the line between source* 12 *and triac Q-*2. *In the prior explanation it is assumed that switch S-*1 *is in a closed condition. This action is repeated on the negative half-cycle resulting in an alternating voltage symmetrical on load* 14. *The position of RV-*1 *will determine the power delivered to load* 14.

A problem solved by the present invention is if RV-1 were at a low ohmic value, high inrush currents demanded by load 14 may be destructive to triac Q-2 and load 14 itself, for example, if load 14 were an incandescent lamp. Thus, the circuit of present invention includes means 34 for delaying the operation of activating means 26. Such delay would cause switch means 16 to progressively increase its firing angle resulting in an increased voltage to load 14. Means 34 may take the form of a capacitor C-2 placed across zener Z-1. The voltage on Z-1 is increased slowly when switch S-1 is energized or closed until, after a number of cycles, the capacitor C-2 charges toward zener voltage. During this period the charge rate of C-1 during each half-cycle is initially slow, resulting in low, or short conduction angles of triac Q-2. Eventually the capacitor C-2 will charge to the xener voltage resulting in a higher or longer conduction angle of triac Q-2 per the present value of RV-1. Thus, a desired light output is achieved with a slight delay.

Figure 2:
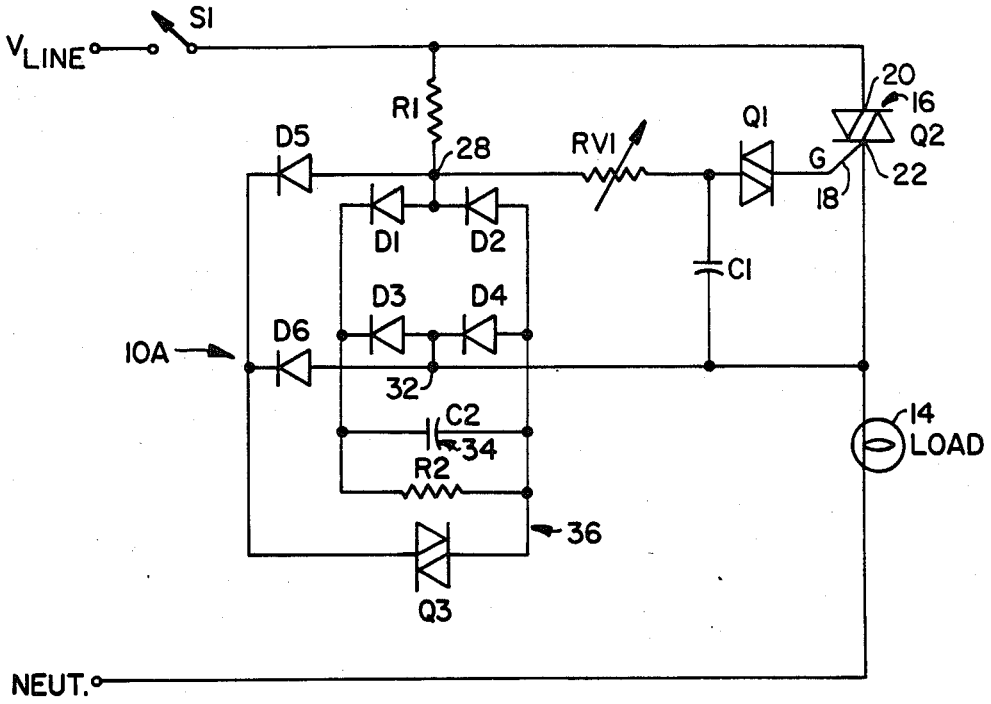
FIG. 2 is a detailed circuit schematic of a second embodiment of the control circuit capable of dimming an incandescent lamp utilizing "soft start" and line voltage compensation features.

Another embodiment of the present invention, FIG. 2, shows a circuit 10A which includes many of the components of circuit 10. Those components identically labeled in FIGS. 1 and 2 may be assumed to be identical components.

Circuit 10A solves another problem which arises in a dimmer circuit where the line voltage from source 12 possesses variations. In such a case circuit 10A includes compensation means 36 for regulating the current output of switch means 16 in relation to variation of the voltage from source 12. Zener Z-1 is replaced by high voltage diac Q-3. It is known that as line voltage increases the diac voltage decreases. When zener Z-1 was used in circuit 10 of FIG. 1 the voltage between nodes 28 and 32 was constant and the charge rate of capacitor C-1 was constant for a given ohmic value of RV-1. Consequently, the turn ON of triac Q-2 was fixed at some point at each half-cycle of the line voltage. However, if the line voltage varied, the dimmer output varied, consequently the light level of load 14, an incandescent lamp, also varied. High voltage diac Q-3 compensates for this variation in that as line voltage increases the diac voltage decreases. The voltage developed between nodes 28 and 32 also decreases slowing the charge rate of capacitor C-1. The turn on of triac Q-2 is delayed and the dimmer output is maintained as a relatively constant voltage. Thus the light level of incandescent lamp 14 is constant. Diodes D-5 and D-6 have been added to the circuit to isolate capacitor C-2 from diac Q-3. It should be noted that diac Q-3 cannot be placed across capacitor C-2, as is the case of zener Z-1, FIG. 1, because of the diac's negative impedance characteristic. In other words diac Q-3 will act as a short circuit when the currents supplied by capacitor C-2 exceeds the diac's breakover voltage. This sudden dumping of the capacitor through diac Q-3 is destructive. Diodes D-5 and D-6 protect capacitor C-2 from diac Q-3.

Resistor R-2 in circuits 10 and 10A serves a as a bleed in relation to capacitor C-2. In other words, when the dimmer is deenergized, resistor R-2 bleeds capacitor C-2.

In operation, the user closes switch S-1 to energize the remaining portion of circuits 10 or 10A which serves as a dimmer to load 14 when the same is an incandescent lamp. Variable resistor RV-1 is adjusted by the user to the desired level. Hysteresis effects are avoided by use of bridge 30 eliminating the need to adjust variable resistor RV-1 after a light level is attained. Circuit 10A automatically compensates for changes in line voltage such that the user need not readjust variable resistor RV-1 in this case also.

The following is the list of components which may be employed in the preferred embodiments:

| COMPONENT | VALUE |
|---|---|
| C-1 | 0.047 ufd. |
| C-2 | 10 ufd. |
| D-1-D-6 | 1N4148 |
| Q-1 | 35 volts |

-continued

| COMPONENT | VALUE |
|---|---|
| Q-2 | 40 amp |
| Q-3 | 45 volts |
| R-1 | 22k ohms |
| R-2 | 560k ohms |
| RV-1 | 0–100k ohms |
| S-1 | 20 amp contacts |
| Z-1 | 50 volts |

While on the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A circuit for controlling the delivery of A.C. electrical voltage from a source to a load comprising:

a. switch means for selectively conducting current from a A.C. source to the load, and switch means including gate lead means for initiating said selective conduction of current from the A.C. source to the load;

b. means for triggering said gate lead means of said switch means, said triggering means being operably connected in series with said gate lead means of said switch means;

c. means for activating said triggering means during a selected time interval to cause said switch means to conduct current from the A.C. source to the load during a period relative to said selected time interval when said triggering means is activated, said activating means being operatively connected to said triggering means, said means for activating said triggering means including;

a variable resistor;

a capacitor, said capacitor being connected to said variable resistor;

means for producing a regulated square wave voltage for driving said variable resistor and connected capacitor, said means for producing a regulated square wave voltage for driving said variable resistor and connected capacitor being connected in parallel with said capacitor and variable resistor between said line source of A.C. voltage and the load, said means for producing a regulated square wave voltage including a full wave rectifier bridge and a regulator diode connected across said bridge; and d. means for delaying the operation of said activating means causing said switch means to progressively increase successive periods of conduction of current from the source to the load, said means for delaying the operation of said activating means comprising a capacitor connected across said means for producing a regulated square wave voltage such that said capacitor charges to the value of said regulated square wave voltage.

2. The circuit of claim 1 which additionally comprises a ON-OFF switch in series with said line A.C. electrical power source.

* * * * *